US011112078B2

(12) United States Patent
Jiang

(10) Patent No.: US 11,112,078 B2
(45) Date of Patent: Sep. 7, 2021

(54) EFFECT WHEEL ASSEMBLY FOR STAGE LIGHT

(71) Applicant: Guangzhou Haoyang Electronic Co., Ltd., Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 16/913,728

(22) Filed: Jun. 26, 2020

(65) Prior Publication Data

US 2020/0326048 A1 Oct. 15, 2020

Related U.S. Application Data

(63) Continuation of application No. PCT/CN2018/107738, filed on Sep. 26, 2018.

(30) Foreign Application Priority Data

Dec. 28, 2017 (CN) ..... 201711460694.7

(51) Int. Cl.
*F21S 10/00* (2006.01)
*F21V 5/00* (2018.01)
*F21W 131/406* (2006.01)

(52) U.S. Cl.
CPC ..... *F21S 10/007* (2013.01); *F21V 5/008* (2013.01); *F21W 2131/406* (2013.01)

(58) Field of Classification Search
CPC ..... F21S 10/007; F21W 2131/406
See application file for complete search history.

(56) References Cited

U.S. PATENT DOCUMENTS 4,891,738 A * 1/1990 Richardson ..... F21S 10/007 362/282
5,113,332 A * 5/1992 Richardson ..... F21V 9/40 362/282

(Continued)

FOREIGN PATENT DOCUMENTS

CN 203336458 U 12/2013
CN 204922832 U 12/2015

(Continued)

*Primary Examiner* — Alexander K Garlen
(74) *Attorney, Agent, or Firm* — Muncy, Geissler, Olds & Lowe, P.C.

(57) ABSTRACT

An effect wheel assembly for a stage light, comprising a plurality of effect wheels, each effect wheel having several effect sheets, a rotating shaft, and a transmission mechanism, the rotating shaft passing through an axle center of each effect wheel. The effect sheets of each of the effect wheels are correspondingly arranged to create various combined effects, and the transmission mechanism drives the rotating shaft to rotate in such a way that the effect wheels rotate coaxially. The effect sheets are driven by the transmission mechanism to rotate coaxially, during the rotating, the effects provided by the effect sheets will overlap such that a new stage effect is presented. The effect wheel assembly can not only meet the demand of multiple effects, but also meet the demand of a simplified structure, which is more practical.

18 Claims, 2 Drawing Sheets

(56) References Cited

U.S. PATENT DOCUMENTS

| | | | | |
|---|---|---|---|---|
| 5,934,794 | A * | 8/1999 | Hutton | F21S 10/007 362/283 |
| 6,971,770 | B2 * | 12/2005 | Rasmussen | F21S 10/007 362/283 |
| 2011/0063847 | A1 * | 3/2011 | Quadri | F21V 11/10 362/284 |
| 2013/0094215 | A1 * | 4/2013 | Jurik | F21V 7/00 362/296.01 |
| 2013/0094219 | A1 * | 4/2013 | Jurik | F21V 14/00 362/322 |
| 2013/0208479 | A1 * | 8/2013 | Allan | F21S 10/007 362/271 |
| 2013/0294080 | A1 * | 11/2013 | Hansen | F21V 21/30 362/271 |
| 2015/0092418 | A1 * | 4/2015 | Jurik | F21V 5/008 362/282 |
| 2016/0069540 | A1 * | 3/2016 | Kjeldsen | F21V 5/007 362/232 |
| 2016/0084457 | A1 * | 3/2016 | Jurik | F21V 11/08 362/324 |
| 2016/0290597 | A1 * | 10/2016 | Jurik | G02B 27/0994 |
| 2018/0283632 | A1 * | 10/2018 | Rasmussen | G03B 25/00 |

FOREIGN PATENT DOCUMENTS

| | | | | |
|---|---|---|---|---|
| CN | 205938963 | U | 2/2017 | |
| CN | 206160036 | U | 5/2017 | |
| CN | 206247246 | U | 6/2017 | |
| CN | 206771249 | U | 12/2017 | |
| CN | 108006576 | A | 5/2018 | |
| EP | 3567302 | A1 * | 11/2019 | F21V 13/00 |
| JP | 2005327668 | A | 11/2005 | |

* cited by examiner

EFFECT WHEEL ASSEMBLY FOR STAGE LIGHT

CROSS REFERENCE TO RELATED APPLICATIONS

The present application is a continuation of International Application No. PCT/CN2018/107738, filed on Sep. 26, 2018, which claims priority from Chinese Patent Application No. 201711460694.7 filed on Dec. 28, 2017, all of which are hereby incorporated herein by reference.

TECHNICAL FIELD

The present invention relates to the technical field of stage lighting, and more particularly to an effect wheel assembly for a stage light.

BACKGROUND ART

With the diversified development of functions of stage lights, the internal functional structure of stage light for various effects becomes increasingly complicated, especially the bulk of some high-end multi-functional lights becomes increasingly larger. However, consumers prefer stage lights with small size and simplified structure, and such stage lights with simplified structure will become the development trend of stage lights in the future. The current main problem thus is how to solve the contradiction that both functional requirements and structural requirements are met.

A user wishes to obtain stage lights with as many stage effects as possible. However, for existing stage lights with multiple effects, due to that a fixed wheel and a rotatable wheel are installed independently from each other, a greater safety distance between the two wheels is required, and a larger space inside the stage light for installing and driving the fixed wheel and the rotatable wheel is also required. Thus, a more compact arrangement for stage lights with various effects is sought-after.

SUMMARY

The present invention seeks to provide a solution to the before-mentioned problems and offers additional benefits to the existing prior art, which provides an effect wheel assembly for a stage light. By means of coaxially combined installation of a plurality of effect wheels, overlapping and cooperation thereof, the effect wheel assembly according to the present invention thus can be more compact and increase effects, which can improve space utilization of a stage light, increase effects and functions of the stage light, and result in a simple structure and convenient operations.

The effect wheel assembly for a stage light according to the present invention comprises a plurality of effect wheels, each effect wheel having several effect sheets, a rotating shaft, and a transmission mechanism, the rotating shaft passing through an axle center of each effect wheel, the effect sheets of each of the effect wheels being correspondingly arranged to create various combined effects, and the transmission mechanism configured to drive the rotating shaft to rotate in such a way that the plurality of effect wheels can rotate coaxially.

In such away, when each effect wheel is driven by the transmission mechanism to rotate coaxially, the effect sheets on the effect wheels will overlap to present various new stage effects. Since the effect wheels are coaxially installed, not only the space for installation is saved, the safety distance between the effect wheels is also reduced, such that the effect wheel assembly can be located closer to a focal point of the stage light, the light spot projected thus has a higher definition to provide a better stage effect.

In order to achieve more stage effects, the plurality of effect wheels comprises at least one fixed effect wheel and at least one rotatable effect wheel, the effect sheets on the fixed effect wheel being stationary relative thereto, the effect sheets on the rotatable effect wheel being motion relative to the rotatable effect wheel by means of a linkage transmission mechanism when the rotating shaft rotates. That is to say, each effect sheet on the fixed effect wheel performs a revolution motion round the rotating shaft, and in addition to the revolution motion, each effect sheet on the rotatable effect wheel can also perform a spinning motion on an axle center thereof.

Preferably, the linkage transmission mechanism comprises a holder, a first gear fixed to the holder, and a second gear arranged on the rotatable effect wheel, the second gear meshing with the first gear, and when the rotatable effect wheel rotates, the second gear on the rotatable effect wheel will mesh with the first gear to make the effect sheets on the rotatable effect wheel to rotate relative to the rotatable effect wheel. Such configuration can further increase the effects.

According to the effect wheel assembly designed in this way, the distance between adjacent effect wheels is less than 2.5 mm. Since the effect wheels are located closer to the focal point of the stage light, the light spot projected has a higher definition, resulting in a better stage effect.

In order to achieve more effects, at least one through hole is provided in each of the effect wheels, and when the through hole of one of the effect wheels overlaps with the effect sheets of the other one of the effect wheels, the effect of the other one of the effect wheels is achieved, or vice versa; and when the effects of two effect wheels overlap, a new effect formed by intersection portions of the overlapping effect sheets is presented by the effect wheel assembly.

In order to meet more demands of a user, the effect sheets are removable effect sheets. The effect sheets can be replaced according to preferences or scene demands to create a different stage effect.

By providing several positioning means on the effect wheels, the effect sheets can be fixed and removed. The user may replace the effect sheets in time according to his own preference and the scene to be rendered to achieve a desired effect without removing the wheel or buying a new light. In order to make the replacement of the effect sheets more convenient, the positioning means are preferably pressing pieces, the effect sheets may be replaced simply by pulling the pressing pieces aside and placing the pressing pieces on the effect sheets after the replacement.

A gobo wheel is a common wheel used for a stage light to generate stage effects. Various beautiful stage effects can be created by the pattern sheets on the gobo wheel. The effect wheels thus are preferably gobo wheels having several pattern sheets, particularly two gobo wheels, which can easily control the stage effects and can provide multiple effects while keep the size of the stage light not be too large. The effect wheels are preferably one fixed gobo wheel and one rotatable gobo wheel, or two rotatable gobo wheels, or two fixed gobo wheels.

In a particular embodiment, the effect wheels may be three comprising one rotatable effect wheel and two fixed effect wheels, or two rotatable effect wheels and one fixed effect wheel, or three rotatable gobo wheels, or three fixed gobo wheels.

The effect wheels may also be a combination of two or three of a gobo wheel, a color wheel, and a fire wheel to create more effects.

The invention further provides a stage light comprising a light source, a condensing device, and a zoom lens group, wherein the light emitted by the light source passes through the condensing device and then converges to a focal point, and the stage light further comprises the effect wheel assembly described above located at or close to the focal point, and a main light beam passes through the effect wheel assembly and the zoom lens group in sequence and then exits.

Compared with the prior art, some beneficial effects can be obtained according to the present invention.

(1) The effect wheel assembly for the stage light of the present invention can reduce the axial and radial safety distances and installation space due to parallel and misaligned installation shafts in separate shaft installations by means of coaxially combined installation of a plurality of effect wheels. Such configuration can also reduce the axial distance between the effect wheels, making each of the effect wheels closer to a focal point of an optical path, which makes imaging clearer. Moreover, new various effects can be produced by overlapping of the gobo wheels with different or the same stage effects. Overall, both compact structure and increase in effects can be achieved to meet requirements of users, and the applicability is significantly improved.

(2) The configuration of a coaxial structure according to the effect wheel assembly for the stage light of the present invention is beneficial to the modular design and installation of the stage light, which not only improves an installation process of the stage light, but also facilitates uniform cleaning and maintenance of the effect sheets during use.

(3) According to the effect wheel assembly for the stage light of the present invention, a fixed gobo wheel and a rotatable gobo wheel are provided, each pattern sheet on the fixed effect wheel can performs a revolution motion round the rotating shaft, and in addition to the revolution motion, each pattern sheet on the rotatable effect wheel can also perform a spinning motion on an axle center thereof, thus further increasing pattern effects.

DETAILED DESCRIPTION OF EMBODIMENTS

Figure 1:
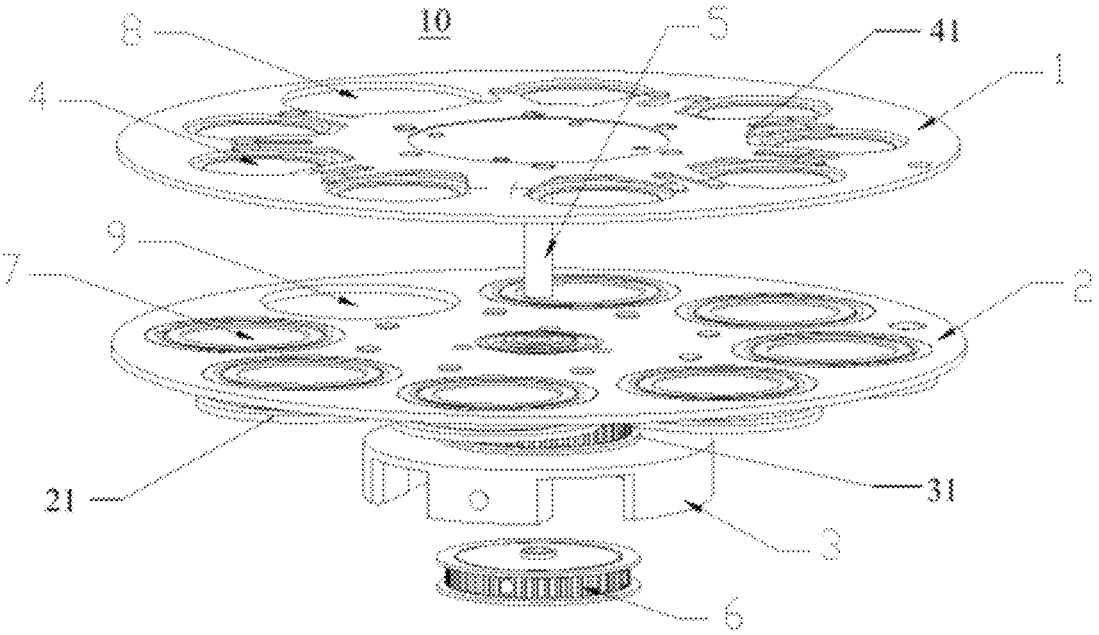
FIG. 1 is a schematic diagram of an exploded structure of an effect wheel assembly for a stage light according to an embodiment.

In order to make the object, technical solutions and advantages of the present invention clearer, embodiments of the present invention are described in further detail below with reference to the accompanying drawings. The drawings are used for illustrative purposes only, are merely schematic diagrams, rather than pictures of a real object, and are not to be construed as limiting this patent. In order to better illustrate the embodiments of the present invention, some parts will be omitted, scaled up or scaled down in the drawings, which does not represent the size of an actual product. It will be appreciated by those skilled in the art that some well-known structures and the illustration thereof could be omitted in the accompanying drawings.

The same or similar reference numerals in the accompanying drawings of the embodiments of the present invention correspond to the same or similar parts. In the description of the present invention, it is to be understood that if the orientation or positional relationship indicated by the terms "upper", "lower", "left", "right", etc. is based on the orientation or positional relationship shown in the drawings, which is intended to facilitate describing the present invention and simplifying the description only, rather than indicating or implying that a device or an element referred to must have a particular orientation or be configured and operated in a particular orientation, and therefore the terms used to describe the positional relationship in the drawings are for illustrative purposes only and are not to be construed as limiting the scope of this patent, and for those skilled in the art, the specific meaning of the above terms may be understood according to specific conditions.

As shown in FIG. 1, The effect wheel assembly 10 for a stage light according to this embodiment comprises a fixed effect wheel 1, a rotatable effect wheel 2, and a rotating shaft 5 connected to an axle center of the fixed effect wheel 1, wherein the rotating shaft 5 passes through the axle center of the rotatable effect wheel 1, and is connected to a transmission mechanism 6 therebeneath, and the transmission mechanism 6 can drive the rotating shaft 5 to rotate so that the rotatable effect wheel 2 and the fixed effect wheel 1 can rotate coaxially.

The rotatable effect wheel 2 has several effect sheets 7 for producing stage effects, and the fixed effect wheel 1 has several effect sheets 4 for producing stage effects. In order to achieve more effects, the rotatable effect wheel 2 is provided with at least one through hole 9 and the fixed effect wheel 1 is provided with at least one through hole 8. Preferably, the through holes 8, 9 and the effect sheets 4, 7 have the same size to ensure that the effect of each of the effect sheets may be shown separately and completely.

The effect sheets 4 on the fixed effect wheel 1 are stationary relative thereto, and the effect sheets 7 on the rotatable effect wheel 2 moves relative thereto by means of a linkage transmission mechanism. The linkage transmission mechanism comprises a holder 3, a first gear 31 fixed to the holder 3, and a second gear 21 arranged on the rotatable effect wheel 2 and meshing with the first gear 31, when the rotatable effect wheel 2 rotates, the second gear 21 on the rotatable effect wheel 2 will mesh with the first gear 31 to drive the effect sheets 7 to rotate relative to the rotatable effect wheel 2. Such motion of the effect sheets 7 relative to the rotatable effect wheel 2 may further increase the effects.

Figure 2:
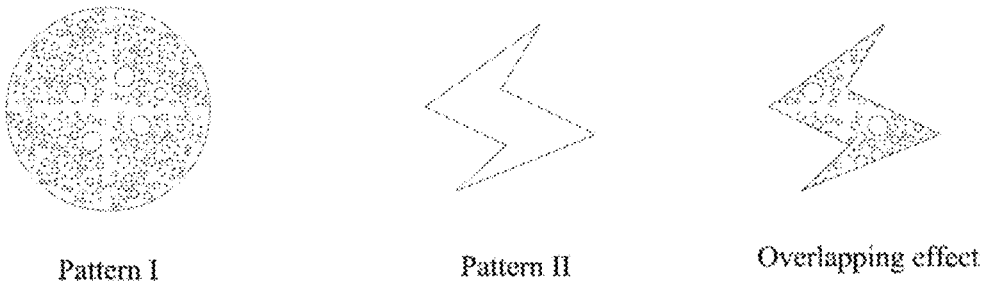
FIG. 2 shows an overlapping effect of the effect wheel assembly for the stage light according to the embodiment.
Figure 3:
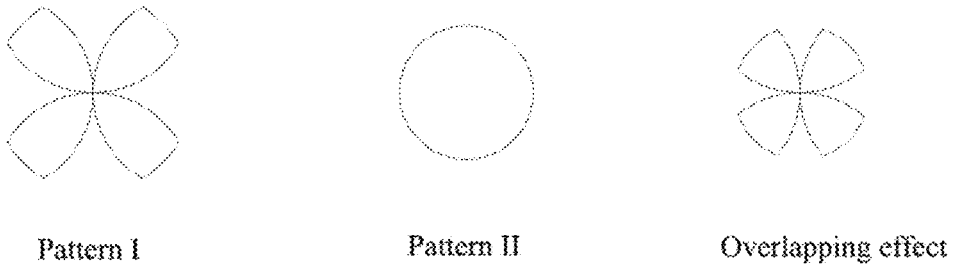
FIG. 3 shows another overlapping effect of the effect wheel assembly for the stage light according to the embodiment.
Figure 4:
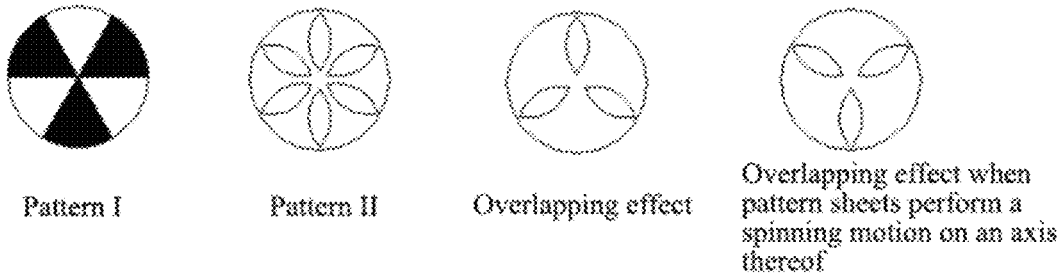
FIG. 4 shows another overlapping effect of the effect wheel assembly for the stage light according to the embodiment.

When the transmission mechanism 6 drives the fixed effect wheel 1 and the rotatable effect wheel 2 to rotate, the effect provided by the effect wheel assembly 10 of this embodiment may also continuously vary. When the through holes 8, 9 overlap in an optical path, since no light ray passes through any of the effect sheets, the effect of the exiting light is a light spot in the same shape of the through holes. When the through holes 8 overlap with any of the effect sheets 7 on the rotatable effect wheel 2 in the optical path, light rays pass through the effect sheet 7 and the effect of the exiting light presents the effect of the effect sheet 7. Likewise, when the through holes 9 overlap with any of the effect sheets 4 on the fixed effect wheel 1 in the optical path, light rays pass through the effect sheet 4, the effect of the exiting light presents the effect of the effect sheet 4. Also, the effect sheets 4 and 7 will provide a new effect formed by their intersection portions during overlapping and separation. In addition, the spinning motion of the effect sheets on the rotatable effect wheel 2 will further increase the effects. The overlapping effects are as shown in FIGS. 2-4, wherein effect I is an effect presented by an effect sheet of the rotatable effect wheel, and effect II is an effect presented by an effect sheet of the fixed effect wheel.

According to a preferable embodiment, the effect sheets are removable, and several positioning means are arranged on the effect wheels for fixing and removing the effect sheets. The positioning means are preferably pressing pieces 41 so that the effect sheets may be replaced by pulling the pressing pieces 41 aside.

The effect wheel assembly 10 for the stage light may also have two rotatable gobo wheels, or two fixed gobo wheels; or may have three gobo wheels comprising one rotatable effect wheel and two fixed effect wheels, or two rotatable effect wheels and a fixed effect wheel, or three rotatable gobo wheels, or three fixed gobo wheels; or may also be a combination of other disks that may provide stage effects, such as a combination of two or three of a gobo wheel, a color wheel, and a fire wheel.

The transmission mechanism may be a gear transmission mechanism or may be other transmission mechanisms well known by those skilled in the art, such as a chain transmission mechanism.

Compared with the prior art, the effect wheel assembly 10 for the stage light can not only meet the demand of multiple stage effects, but also meet the demand of a simplified structure, which is more practical.

Figure 5:
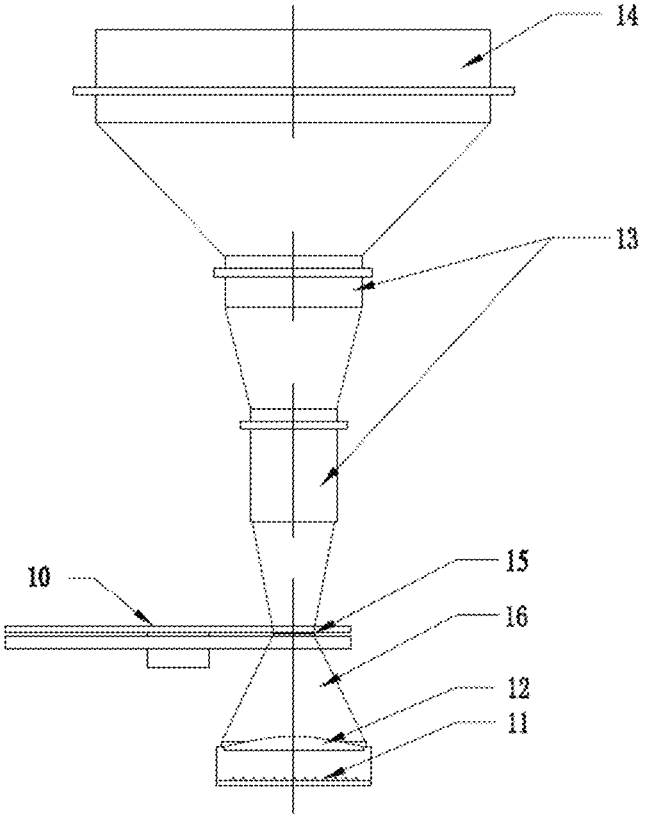
FIG. 5 shows a stage light with the effect wheel assembly according to another embodiment.

FIG. 5 shows a stage light with the above-mentioned effect wheel assembly 10, comprising a light source 11, a condensing device 12, and a zoom lens group 13, the light emitted by the light source 11 passing through the condensing device 12 and then converging to a focal point 15. The effect wheel assembly 10 is arranged at or close to the focal point 15 of the stage light, and a main light beam 16 passes through the effect wheel assembly 10 and the zoom lens group 13 in sequence and then exits from an output lens 14.

Obviously, the above embodiments of the present invention are merely embodiments used for clearly describing the present invention, instead of limiting the implementation modes of the present invention. For those of ordinary skill in the art, other different forms of changes or variations could have also been made on the basis of the above-mentioned illustration. There is no need and no way to exhaustively list all implementations here. Any modifications, equivalent replacements, improvements, etc. made within the spirit and principle of the present invention should be encompassed within the scope of protection of the claims of the present invention.

The invention claimed is:

1. An effect wheel assembly for a stage light comprising a plurality of effect wheels, each effect wheel having several effect sheets;

a rotating shaft passing through an axle center of each effect wheel; and a transmission mechanism, wherein the effect sheets of each effect wheel are respectively correspondingly arranged to create various combined effects, and the transmission mechanism drives the rotating shaft to rotate so that the effect wheels rotate coaxially, wherein the effect sheets on at least one of the plurality of effect wheels are motion relative to the at least one of the plurality of effect wheels by a linkage transmission mechanism when the rotating shaft rotates, wherein the linkage transmission mechanism comprises:

a holder;

a first gear fixed to the holder; and a second gear arranged on the at least one of the plurality of effect wheels and meshing with the first gear, wherein when the at least one of the plurality of effect wheels rotates, the second gear on the at least one of the plurality of effect wheels meshes with the first gear to make the effect sheets on the at least one of the plurality of effect wheels to rotate relative to the at least one of the plurality of effect wheels.

2. The effect wheel assembly for the stage light according to claim 1, wherein when in use, the plurality of effect wheels are located at or close to a focal point of the stage light.

3. The effect wheel assembly for a stage light according to claim 1, wherein the plurality of effect wheels comprise at least one fixed effect wheel and at least one rotatable effect wheel, the effect sheets on the fixed effect wheel are stationary relative thereto, and the effect sheets on the rotatable effect wheel being motion relative to the rotatable effect wheel by the linkage transmission mechanism when the rotating shaft rotates.

4. The effect wheel assembly for the stage light according to claim 3, wherein the second gear is arranged on the rotatable effect wheel, wherein when the rotatable effect wheel rotates, the second gear on the rotatable effect wheel meshes with the first gear to make the effect sheets on the rotatable effect wheel to rotate relative to the rotatable effect wheel.

5. The effect wheel assembly for the stage light according to claim 1, wherein a distance between adjacent effect wheels is less than 2.5 mm.

6. The effect wheel assembly for the stage light according to claim 1, wherein at least one through hole is provided on each effect wheel.

7. The effect wheel assembly for the stage light according to claim 6, wherein when the through hole of one of the plurality of effect wheels overlaps with the effect sheets of another effect wheels, an effect of another effect wheels is presented; and when the effect sheets on the effect wheels overlap, a new effect created by intersection portions of the effect sheets overlapped is presented, thereby increasing effects of the stage light.

8. The effect wheel assembly for the stage light according to claim 1, wherein the effect sheets are removable.

9. The effect wheel assembly for the stage light according to claim 8, wherein several positioning means are arranged on each effect wheels for fixing and removing the effect sheets.

10. The effect wheel assembly for the stage light according to claim 9, wherein the positioning means are designed as pressing pieces.

11. The effect wheel assembly for the stage light according to claim 1, wherein the plurality of effect wheels are gobo wheels.

12. The effect wheel assembly for the stage light according to claim 11, wherein the plurality of effect wheels are a combination of two gobo wheels comprising one fixed gobo wheel and one rotatable gobo wheel, or two rotatable gobo wheels, or two fixed gobo wheels.

13. The effect wheel assembly for the stage light according to claim 11, wherein the plurality of effect wheels are a combination of three gobo wheels comprising two fixed gobo wheels and one rotatable gobo wheel, or two rotatable gobo wheels and one fixed gobo wheel, or three rotatable gobo wheels, or three fixed gobo wheels.

14. The effect wheel assembly for the stage light according to claim 1, wherein the plurality of effect wheels are a combination of two or three effect wheels selected from a group of a gobo wheel, a color wheel, and a dynamic wheel.

15. A stage light comprising a light source, a condensing device, a zoom lens group, and an effect wheel assembly of claim 1, wherein light emitted by the light source passes through the condensing device and then converges to a focal point, the effect wheel assembly is arranged at or close to the focal point of the stage light, and a main light beam passes through the effect wheel assembly and the zoom lens group in sequence and then exits.

16. An effect wheel assembly for a stage light, comprising a plurality of effect wheels which rotate coaxially, each effect wheel correspondingly having several effect sheets, wherein the plurality of effect wheels comprise at least one rotatable effect wheel, and the effect sheets thereon are rotatable relative thereto, and wherein the plurality of effect wheels are arranged close to a focal point of the stage light in such a way that a light spot projected has improved definition and various combined stage effects are provided, wherein the plurality of effect wheels are connected by a rotating shaft, and the rotating shaft is rotated by a transmission mechanism, thereby driving the effect wheels to perform coaxial rotational movement, wherein the effect sheets of the at least one rotatable effect wheel are rotated by a linkage transmission mechanism, and the linkage transmission mechanism comprises:

a holder;

a first gear fixed to the holder; and a second gear arranged on the at least one rotatable effect wheel and meshing with the first gear, wherein when the at least one rotatable effect wheels rotates, the second gear on the at least one rotatable effect wheel meshes with the first gear to make the effect sheets on the at least one rotatable effect wheels to rotate relative to the at least one rotatable effect wheel.

17. The effect wheel assembly for the stage light according to claim 16 wherein a distance between the adjacent effect wheels is less than 2.5 mm.

18. The effect wheel assembly for the stage light according to claim 16, wherein each effect wheel is correspondingly provided with a plurality of through holes, when the through holes of one of the effect wheels overlap with the effect sheets of another effect wheels, an effect of the another effect wheels is presented; and when the effect sheets on the effect wheels overlap, a new effect created by intersection portions of the effect sheets overlapped is presented, thereby increasing effects of the stage light.

* * * * *